US010033126B2

(12) United States Patent
Sekino et al.

(10) Patent No.: US 10,033,126 B2
(45) Date of Patent: Jul. 24, 2018

(54) CONNECTOR

(71) Applicant: YAZAKI CORPORATION, Tokyo (JP)

(72) Inventors: Tetsuya Sekino, Shizuoka (JP); Nobuyuki Sakamoto, Shizuoka (JP); Toshinori Yamamoto, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 15/657,462

(22) Filed: Jul. 24, 2017

(65) Prior Publication Data

US 2018/0034180 A1 Feb. 1, 2018

(30) Foreign Application Priority Data

Jul. 29, 2016 (JP) ..... 2016-149191

(51) Int. Cl.

| | |
|---|---|
| ***H01R 13/28*** | (2006.01) |
| ***H01R 13/24*** | (2006.01) |
| ***H01R 9/03*** | (2006.01) |
| ***H01R 13/703*** | (2006.01) |
| ***H01R 13/436*** | (2006.01) |
| *H01R 13/422* | (2006.01) |

(52) U.S. Cl.

CPC ..... *H01R 13/28* (2013.01); *H01R 9/03* (2013.01); *H01R 13/2464* (2013.01); *H01R 13/4365* (2013.01); *H01R 13/7031* (2013.01); *H01R 13/4223* (2013.01)

(58) Field of Classification Search

CPC ..... H01R 13/4223; H01R 13/4365; H01R 13/28; H01R 13/7032; H01R 13/7031

See application file for complete search history.

(56) References Cited

U.S. PATENT DOCUMENTS 4,767,361 A * 8/1988 Hoshino ..... H01R 13/422 439/596
5,277,608 A * 1/1994 Oda ..... H01R 13/7032 200/51.1
5,803,756 A * 9/1998 Furutani ..... H01R 13/7032 200/51.1

(Continued)

FOREIGN PATENT DOCUMENTS

JP 2007-073268 A 3/2007

*Primary Examiner* — Briggitte R Hammond
(74) *Attorney, Agent, or Firm* — Sughrue Mion, PLLC

(57) ABSTRACT

A connector includes a first housing accommodating first terminals, a second housing accommodating second terminals connectable to the first terminals and fittable to the first housing, short-circuit terminals accommodated in the first housing and each having a pair of contact pieces that respectively come in contact with corresponding first terminals adjacent to each other, releasing parts provided in the second housing and configured so as to displace the contact pieces, thereby releasing contacts between the first terminals and the contact pieces, tin plating films formed on respective contact surfaces of the first terminals and the contact pieces coming into contact with each other, and sliding parts provided in the second housing and positioned ahead of the releasing parts in a fitting direction between the first housing and the second housing to displace the contact pieces thereby allowing the contact pieces to slide on the first terminals.

3 Claims, 10 Drawing Sheets

(56) References Cited

U.S. PATENT DOCUMENTS

| | | | | | |
|---|---|---|---|---|---|
| 5,816,834 | A * | 10/1998 | Nimura | H01R 13/7032 | 200/51.1 |
| 5,997,344 | A * | 12/1999 | Shinozaki | H01R 13/5213 | 439/188 |
| 6,135,828 | A * | 10/2000 | Lalange | H01R 13/7032 | 439/188 |
| 6,827,596 | B2 * | 12/2004 | Hori | H01R 13/6275 | 439/188 |
| 7,275,946 | B2 * | 10/2007 | Ohtaka | H01R 13/7032 | 200/51.1 |
| 2007/0054547 | A1 | 3/2007 | Ohtaka et al. | | |

* cited by examiner

CONNECTOR

CROSS REFERENCE TO RELATED APPLICATION

The present application is based on, and claims priority from Japanese Patent Application No. 2016-149191, filed Jul. 29, 2016, the disclosure of which is hereby incorporated by reference herein in its entirety.

TECHNICAL FIELD

The present application relates to a connector, and more specifically to a connector having a short-circuit terminal connecting among a plurality of terminals accommodated in a housing.

BACKGROUND ART

As a conventional connector, there is known a connector that includes a first housing accommodating female terminals as a plurality of first terminals, a second housing which is fittable to the first housing and which accommodates male terminals as a plurality of second terminals connectable to the female terminals, a short-circuit terminal accommodated in the first housing to have contact pieces in contact with the adjacent female terminals, and releasing pieces provided in the second housing to displace the contact pieces, thereby cancelling the contact between the female terminals and the contact pieces (see US 2007/0054547 A1).

In the plurality of female terminals accommodated in the first housing of the conventional connector, for example, two adjacent female terminals are connected to an air bag circuit that controls the operation of an air bag.

The two adjacent female terminals are connected to each other through the contact piece since they come into contact with the contact piece of the short-circuit terminal accommodated in the first housing under a condition that the first housing and the second housing are not fitted to each other.

In this way, by connecting the two female terminals through the short-circuit terminal under the condition that the first housing and the second housing are not fitted to each other, there is no possibility that a potential difference is produced between the two female terminals, thereby preventing an erroneous inflation of the air bag.

The connection between the two female terminals and the short-circuit terminal is cancelled since the fitting of the first housing and the second housing allows the contact pieces of the short-circuit terminal to be displaced by the releasing pieces of the second housing so that the contact between the female terminals and the contact pieces is cancelled.

SUMMARY

In the conventional connector, when the first housing and the second housing are fitted to each other, the contact pieces of the short-circuit terminal are displaced by the releasing parts.

In the conventional connector, the larger the contact load of the contact pieces to the first terminals gets, the greater the fitting force between the first housing and the second housing becomes. However, if the contact load of the contact pieces is reduced, there arises a possibility that the connection reliability between the first terminals and the short-circuit terminal is deteriorated.

In the conventional connector, therefore, gold-plating films are formed on respective contact surfaces of the first terminal and the contact pieces coming into contact each other in order to reduce the contact load of the contact pieces while ensuring the connection reliability. However, the formation of such gold-plating films is so expensive as to cause the manufacturing cost of the connector to be elevated.

Therefore, it is an object of the present application to provide a connector which is capable of reducing manufacturing cost while maintaining connection reliability between first terminals and a short-circuit terminal.

A connector according to an aspect of the present application includes: a first housing accommodating a plurality of first terminals; a second housing accommodating a plurality of second terminals connectable to the first terminals and fittable to the first housing; one or more short-circuit terminals accommodated in the first housing and each having a pair of contact pieces that respectively come in contact with corresponding first terminals adjacent to each other in the first terminals; one or more releasing parts provided in the second housing and configured so as to displace the contact pieces thereby releasing the contact between the first terminals and the contact pieces; tin plating films formed on respective contact surfaces of the first terminals and the contact pieces coming into contact with each other; and one or more sliding parts provided in the second housing and positioned ahead of the releasing parts in a fitting direction between the first housing and the second housing to displace the contact pieces thereby allowing the contact pieces to slide on the first terminals.

Although the manufacturing cost could be saved in comparison with a connector having gold-plating films formed on the contact surfaces due to the formation of the tin plating films, the contact surfaces of the first terminal and the contact pieces would be formed with oxide films which increase their contact resistances.

However, as the second housing is provided with the sliding parts which displace the contact pieces to allow them to slide on the first terminals, the oxide films are removed by slide movements of the contact pieces and the first terminal due to the sliding parts, so that the first terminals and the contact pieces can be brought into contact with each other through resulting newly-generated surfaces.

In the connector according to the aspect of the present application, therefore, even if forming inexpensive tin-plating films on the contact surfaces of the first terminals and the contact pieces while reducing the contact loads of the contact pieces, the oxide films could be removed by the slide movements of the contact pieces and the first terminals by the sliding parts, thereby allowing the manufacturing cost to be reduced while maintaining the connection reliability between the first terminals and the shirt-circuit terminals.

Each of the sliding parts may be positioned between the pair of contact pieces of corresponding short-circuit terminal in the short-circuit terminals.

In such an arrangement that each of the sliding parts is positioned between the pair of contact pieces of corresponding short-circuit terminal, it is possible to suppress the enlarging of the sliding parts since two contact pieces can be displaced by a single sliding part.

With the connector according to the aspect of the present application, it is possible to reduce the manufacturing cost while maintaining the connection reliability between the first terminals and the short circuit terminal.

DESCRIPTION OF EMBODIMENTS

Figure 1:
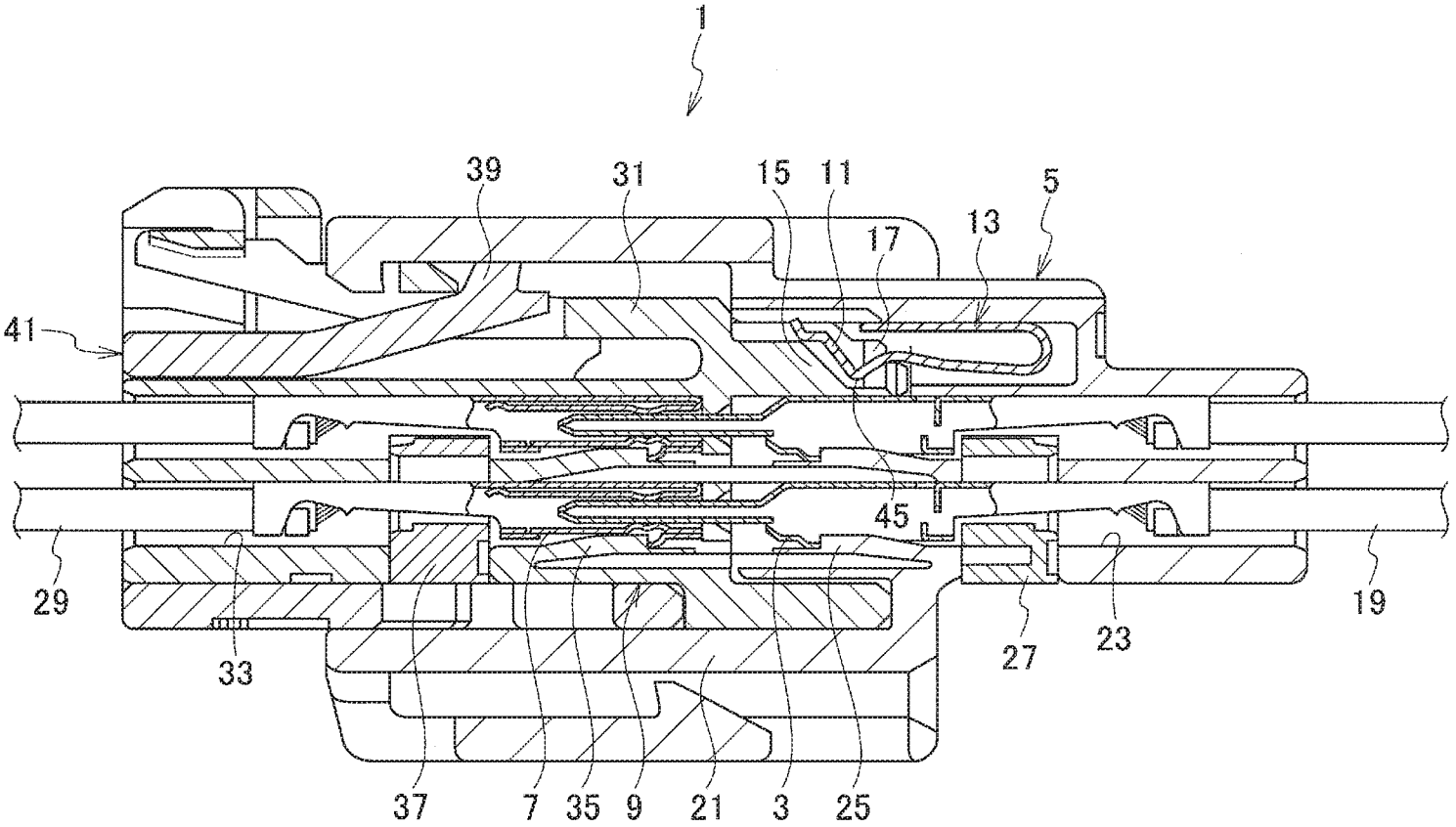
FIG. 1 is a sectional view of a connector according to an embodiment.
Figure 2:
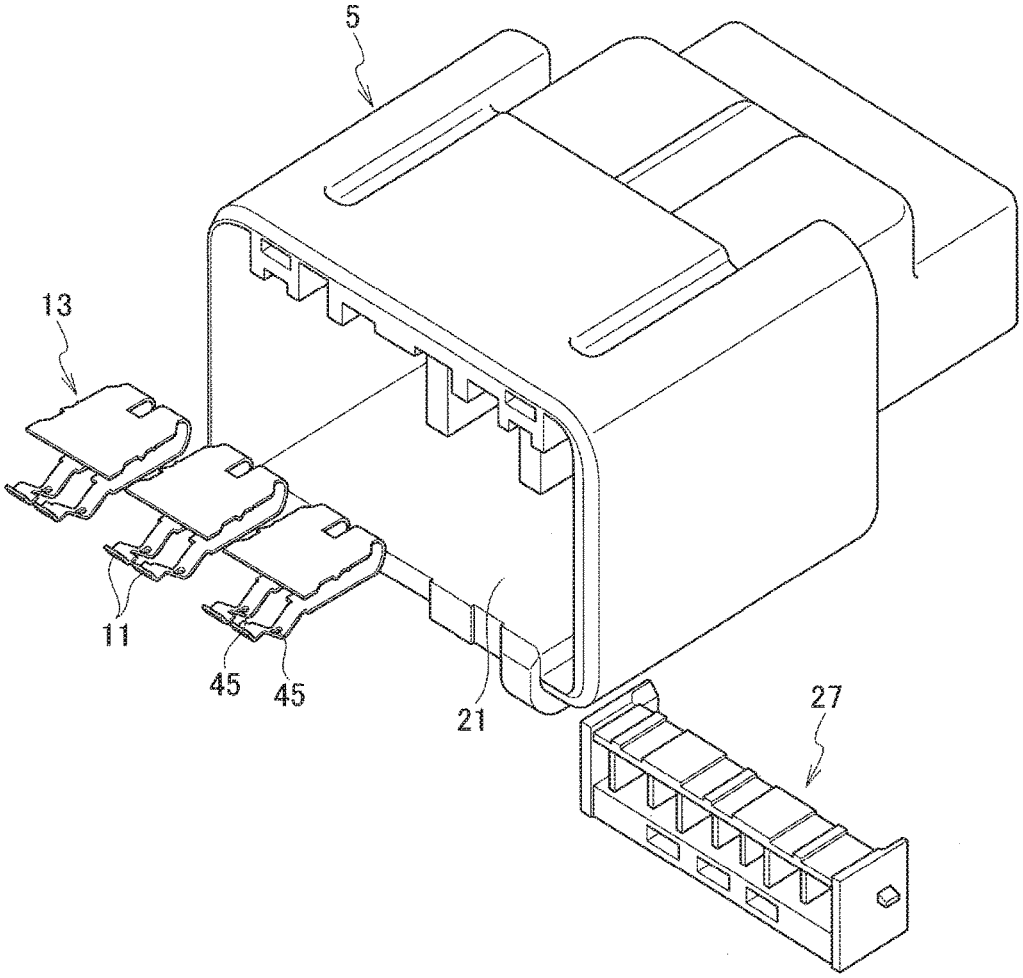
FIG. 2 is an exploded perspective view of a first housing of the connector according to the embodiment.
Figure 3:
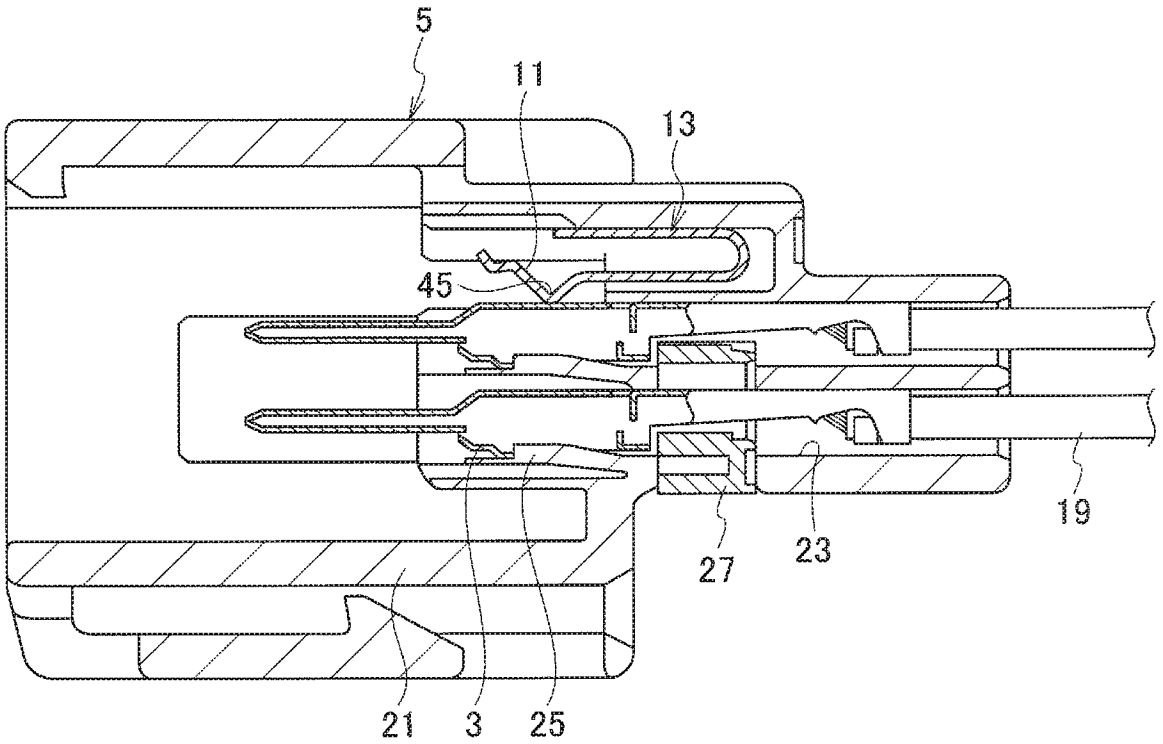
FIG. 3 is a sectional view of the first housing of the connector according to the embodiment.
Figure 4:
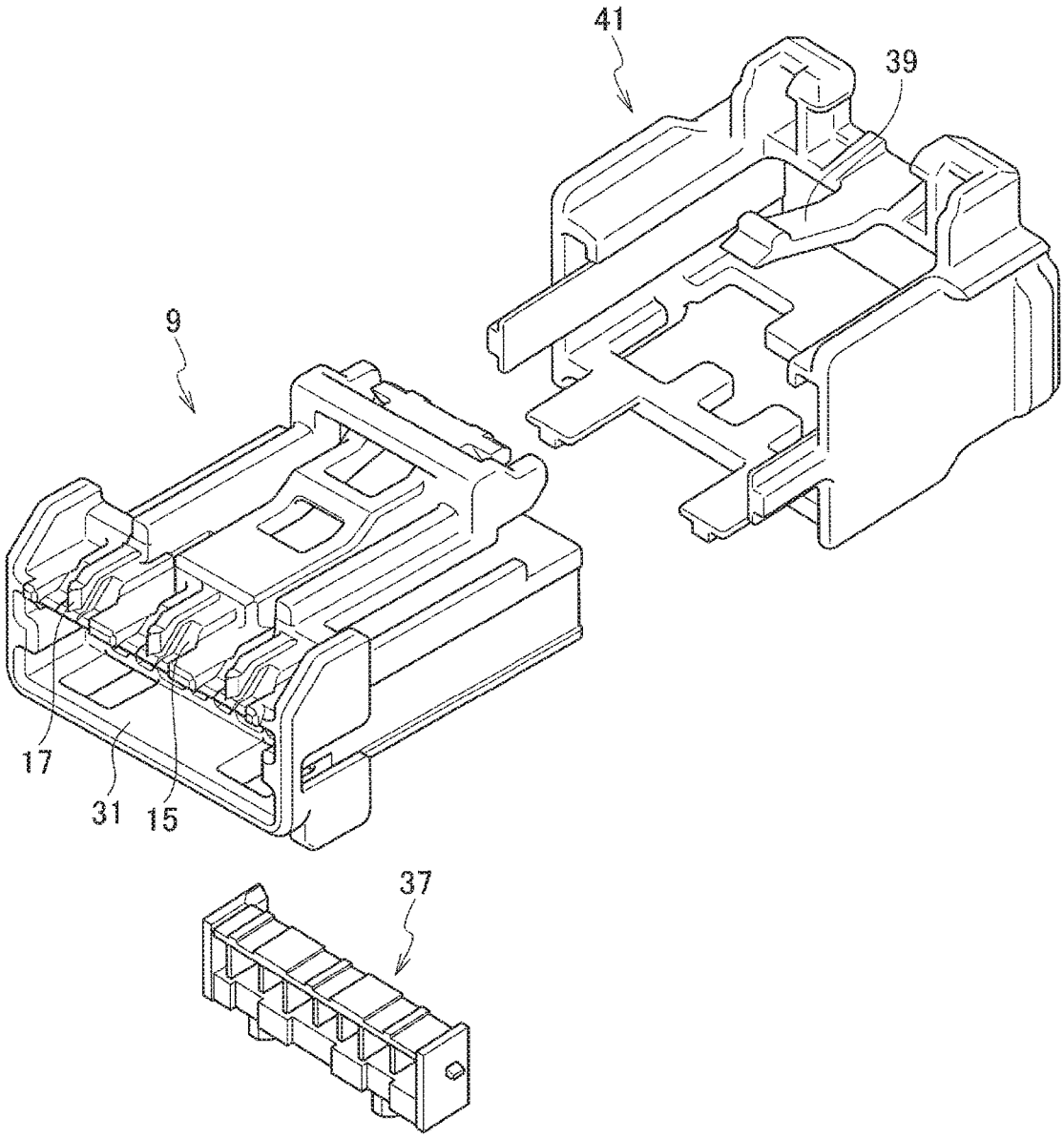
FIG. 4 is an exploded perspective view of a second housing of the connector according to the embodiment.
Figure 5:
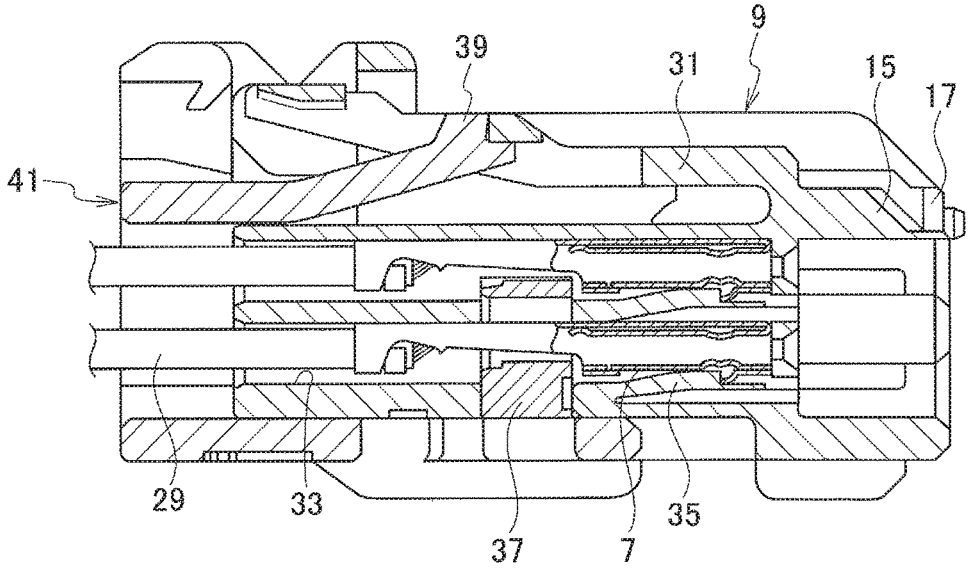
FIG. 5 is sectional view of the second housing of the connector according to the embodiment.
Figure 6:
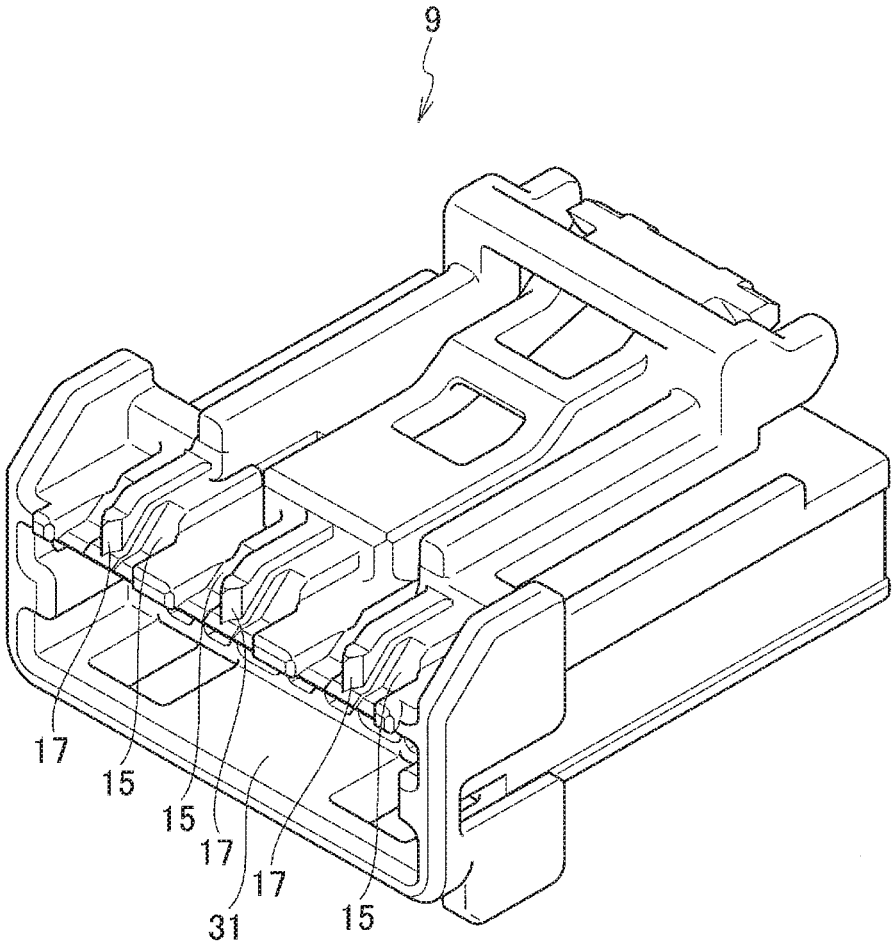
FIG. 6 is a perspective view of the second housing of the connector according to the embodiment.
Figure 7:
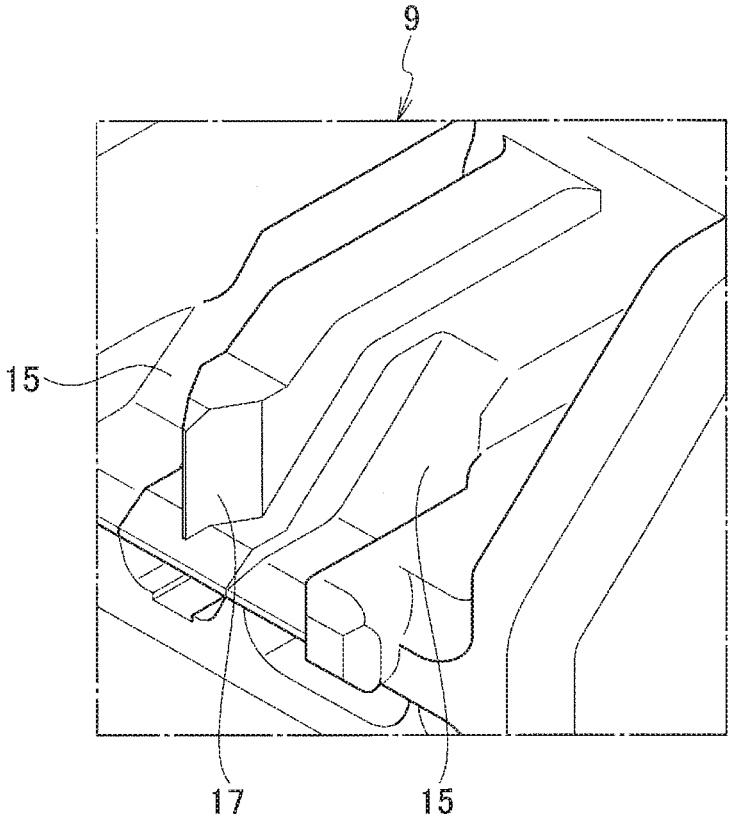
FIG. 7 is an enlarged view of an essential part of FIG. 6.
Figure 8A:
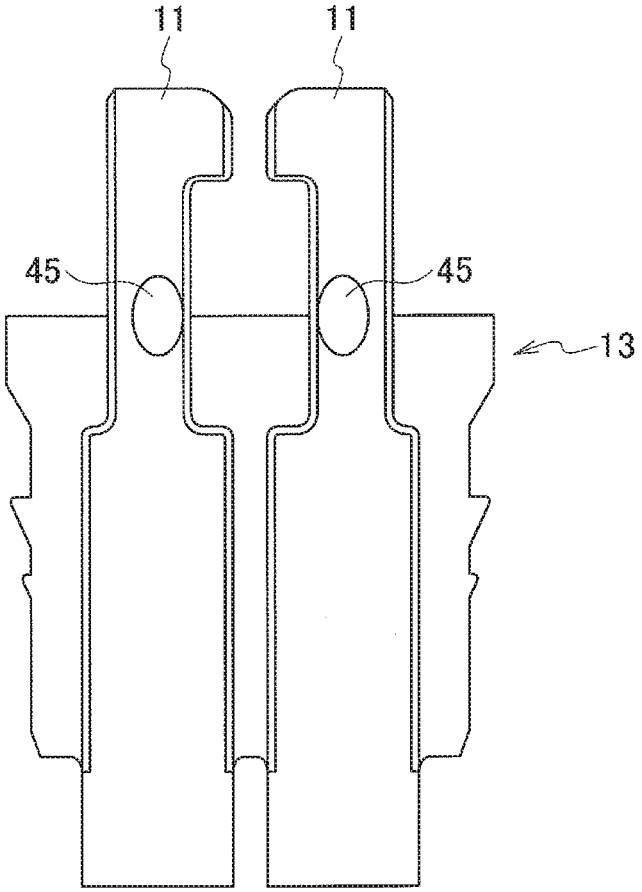
FIG. 8A is a front view of a short-circuit terminal of the connector according to the embodiment.
Figure 8B:
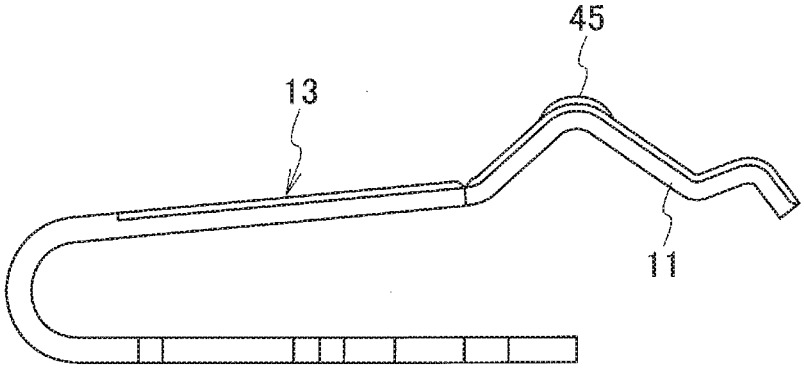
FIG. 8B is a side view of the short-circuit terminal of the connector according to the embodiment.

A connector according to an embodiment will be described with reference to FIGS. 1 to 10.

The connector 1 according to the embodiment includes a first housing 5 accommodating a plurality of first terminals 3, a second housing 9 which accommodates a plurality of second terminals 7 connectable to the first terminals 3 and which is fittable to the first housing 5, short-circuit terminals 13 accommodated in the first housing 5 each having contact pieces 11, 11 coming into contact with adjacent first terminals 3, 3, and releasing parts 15 provided in the second housing 9 to displace the contact pieces 11 for releasing the contacts between the first terminals 3 and the contact pieces 11.

Tin-plating films are formed on respective contact surfaces of the first terminal 3 and the contact pieces 11, which come into contact with each other. The second housing 9 is provided with sliding parts 17 which are disposed on the front side of each of the releasing parts 15 in the fitting direction between the first housing 5 and the second housing 9 to displace the contact pieces 11, thereby allowing the contact pieces 11 to slide on the first terminals 3.

Each of the sliding parts 17 is positioned between the contact pieces 11, 11 of corresponding short-circuit terminal 13.

Each of the first terminals 3 is a male terminal having a tab-shaped connecting part. The first terminals 3 are electrically connected to respective terminal parts of a plurality of electric wires 19 connected to an air bag circuit for controlling the operation of an air bag.

The first terminals 3 are inserted into the first housing 5 through an opening formed in the first housing 5 and finally accommodated in the first housing 5.

The first housing 5 is made of insulating material such as synthetic resin. The first housing 5 is provided, on the opposite side to the opening allowing for the insertion of the first terminals 3, with a first fitting part 21 in which the second housing 9 can be fitted. The first fitting part 21 is provided, on its bottom side, with a plurality of first terminal accommodating chambers 23 for accommodating the first terminals 3 respectively.

In each of the first terminal accommodating chambers 23, a first locking lance 25 is bendably provided so as to lock corresponding first terminal 3. By inserting a first spacer 27 into an opening communicating with the first terminal accommodating chambers 23, each of the first terminals 3 is doubly locked.

With the second housing 9 fitted to the first fitting part 21 of the first housing 5, the first terminals 3 accommodated in the first housing 5 are connected to the second terminals 7 accommodated in the second housing 9, respectively.

Each of the second terminals 7 is a female terminal having a box-shaped connecting pat into which the tab-shaped connecting part of corresponding first terminal 3 can be inserted. The second terminals 7 are electrically connected to respective terminal parts of a plurality of electric wires 29 connected to such as a power supply or a device.

The second terminals 7 are inserted into the second housing 9 through an opening formed in the second housing 9 and finally accommodated in the second housing 9.

The second housing 9 is made of insulating material such as synthetic resin. The second housing 9 is provided, on an opposite side to the opening allowing for the insertion of the second terminals 7, with a second fitting part 31 which can be inserted into the first fitting part 21 of the first housing 5. A plurality of second terminal accommodating chambers 33 for accommodating the second terminals 7 are provided in the second fitting part 31.

In each of the second terminal accommodating chambers 33, a second locking lance 35 is bendably provided so as to lock corresponding second terminal 7. By inserting a second spacer 37 into an opening communicating with the second terminal accommodating chambers 33, each of the second terminals 7 is doubly locked.

Through a bendable locking part 39, a cap housing 41 is assembled onto the outer circumference of the second housing 9 on the drawer side of the electric wires 29 at a temporary locking position (see FIG. 5), When the first housing 5 and the second housing 9 are in a half-fitting state, the cap housing 41 cannot be shifted from the temporary locking position. While, when the first housing 5 and the second housing 9 are fitted to each other, then the cap housing 41 is shifted to a primary locking position (see FIG. 1) with a change of the locking position of the locking part 39.

With the positional shifting of the cap housing 41 between the temporary locking position and the primary locking position, it is possible to detect the fitting state between the first housing 5 and the second housing 9.

With the second fitting part 31 of the second housing 9 fitted to the first fitting part 21 of the first housing 5, the first terminals 3 accommodated in the first housing 5 are electrically connected to the second terminals 7 accommodated in the second housing 9, respectively.

In a situation where the fitting between the first housing 5 and the second housing 9 is cancelled by maintenance or the like, there is a possibility that a potential difference is produced among the first terminals 3 accommodated in the first housing 5 and also connected to an airbag circuit, thereby causing an erroneous inflation of the air bag.

In order to avoid such an occurrence of a potential difference among the first terminals 3, therefore, the plurality of short-circuit terminals 13 are accommodated in the first housing 5. Each of the short-circuit terminals 13 is provided to electrically connect two adjacent first terminals 3, 3 of the plurality of first terminals 3 with each other.

Each of the short-circuit terminals 13 is made from a single conductive material subjected to press working or bending processing. Each of the short-circuit terminals 13 is provided, on one end thereof, with two elastically-deformable contact pieces 11, 11.

Each of the contact pieces 11 is adapted so as to be elastically deformable in both vertical and horizontal directions. Each of the contact pieces 11 is provided, on its free-end side, with a contact part 45 which protrudes toward corresponding first terminal 3 in such a situation that the short-circuit terminals 13 are accommodated in the first housing 5.

Since the pair of contact parts 45 of each of the contact pieces 11 comes into contact with the outer circumferential surfaces of corresponding two adjacent first terminals 3 by predetermined urging forces of the contact pieces 11, the two adjacent first terminals 3, 3 are electrically connected to each other through corresponding short-circuit terminal 13.

By electrically connecting the two first terminals 3, 3 through corresponding short-circuit terminal 13, no potential difference is generated between the two first terminals 3, 3, thereby preventing an erroneous inflation of the airbag.

When the first housing 5 and the second housing 9 are fitted to each other, the contact pieces 11 of each of the short-circuit terminals 13 are displaced by corresponding releasing part 15 provided in the second housing 9, so that the contacts between the contact parts 45 and the first terminals 3 are cancelled.

The releasing parts 15 are arranged on the front side in the fitting direction between the first housing 5 and the second housing 9. Also, the releasing parts 15 are arranged in positions that allow them to be abutted on the contact pieces 11 of the short-circuit terminals 13 accommodated in the first housing 5 under the condition that the second housing 9 is fitted to the first housing 5. These releasing parts 15 are made from a single member continuing to the second housing 9.

Each of the releasing parts 15 is provided, on its distal end on the first housing 5 side, with an inclined surface which is inclined upward from the first housing 5 side toward the second housing 9 side.

When the first housing 5 is to be fitted to the second housing 9, the distal end of each of the releasing parts 15 abuts on the free end side of the contact piece 11 of corresponding short-circuit terminal 13. Then, with the progress of the fitting between the first housing 5 and the second housing 9, the free end side of each of the contact pieces 11 slides along the inclined surface of corresponding releasing part 15, so that the contact pieces 11 are displaced upward.

In this way, with the releasing parts 15 displacing the contact pieces 11, the contacts between the contact parts 45 of the contact pieces 11 and the first terminals 3 are released and therefore, the electrical connections between the adjacent first terminals 3, 3 are cancelled. Then, when the first housing 5 and the second housing 9 are fitted to each other, the first terminals 3 and the second terminals 7 are electrically connected to each other.

In the connector 1 according to the embodiment, the urging force of each of the contact pieces 11 of the short-circuit terminals 13 is reduced to reduce the fitting force between the first housing 5 and the second housing 9. Additionally, for the purpose of reducing the manufacturing cost, the contact surfaces of each of the first terminals 3 and each of the contact pieces 11 of the short-circuit terminals 13 are formed with tin-plating films each of which is cheaper than a gold-plating film.

Although the tin-plating film is cheaper than the gold-plating film, there is a possibility that an oxide film is formed on the tin-plating surface, so that the contact resistance between the first terminals 3 and the contact pieces 11 is increased to deteriorate the connection reliability.

Therefore, the second housing 9 is provided with the plurality of sliding parts 17 for removing the oxide film formed on the tin-plating surface.

Each of the sliding parts 17, which is a single member continuing to the second housing 9, is formed so as to be a rib extending along the fitting direction between the first housing 5 and the second housing 9. The distal end of each of the sliding parts 17 on the first housing 5 side is arranged ahead of each of the releasing parts 15 in the fitting direction.

Each of the sliding parts 17 is provided, on its distal end side, with a tapered surface to be tapered toward the first housing 5. The plurality of sliding parts 17 are arranged so as to be respectively positioned between the contact pieces 11, 11 of the respective short-circuit terminals 13 accommodated in the first housing 5.

Figure 9:
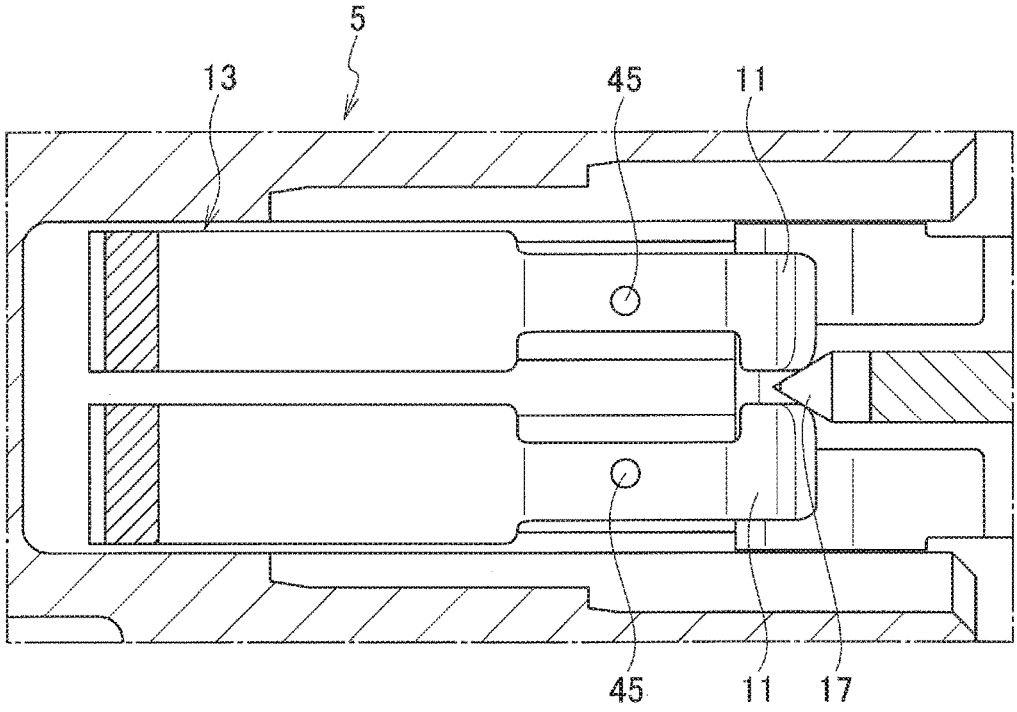
FIG. 9 is a sectional view of a state when inserting a sliding part between contact pieces of the short-circuit terminal according to the embodiment.
Figure 10:
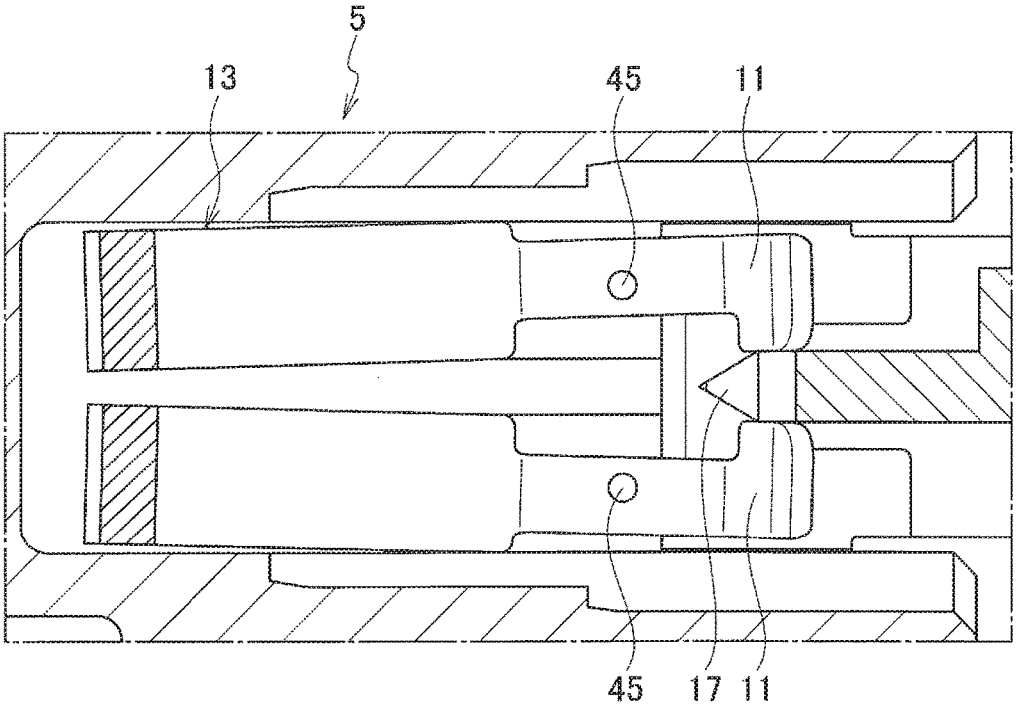
FIG. 10 is a sectional view of a state where the sliding part has been inserted between the contact pieces of the short-circuit terminal according to the embodiment.

As illustrated in FIGS. 9 and 10, when the first housing 5 and the second housing 9 are fitted to each other, each of the sliding parts 17 is inserted between the two contact pieces 11, 11 of corresponding short-circuit terminal 13 to displace the contact pieces 11, 11 in the directions to separate them from each other while sliding on the contact pieces 11, 11 on both sides of the corresponding short-circuit terminal 13.

At this time, the contact pieces 11, 11 of the respective short-circuit terminals 13 have not been displaced upward by the respective releasing parts 15 owing to the arrangement where the sliding parts 17 are arranged ahead of the releasing parts 15 in the fitting direction. That is, the contact points 45, 45 of the contact pieces 11, 11 of the respective short-circuit terminals 13 are brought into contact with the corresponding first terminals 3, 3.

Subsequently to this state, under a condition that the contact pieces 11 are displaced upward by the releasing parts 15 so that the first housing 5 and the second housing 9 are fitted to each other, the contacts between the contact parts 45 of the contact pieces 11 and the first terminals 3 are cancelled.

When the fitting between the first housing 5 and the second housing 9 is cancelled by maintenance or the like, then the slide movements between the releasing parts 15 and the contact pieces 11 are terminated to allow the contact pieces 11 to be restored downward, so that the contact parts 45 of the contact pieces 11 are brought into contact with the first terminals 3.

Thereafter, when advancing the cancelling of the fitting between the first housing 5 and the second housing 9 furthermore, each of the sliding parts 17 comes out from the part between the contact pieces 11, 11 of corresponding short-circuit terminal 13, so that the contact pieces 11, 11 are displaced so as to restore themselves in the direction approaching each other.

With the displacements of the contact pieces 11, 11, as the contact parts 45, 45 of the contact pieces 11, 11 slide on the contact surfaces of the first terminals 3, 3, it is possible to remove the oxide films formed on the contact surfaces of the contact parts 45, 45 and the first terminals 3, 3.

In this way, with the arrangement where the sliding parts 17 allow the contact parts 45 of the contact pieces 11 to slide on the first terminals 3 to remove the oxide films, the contact parts 45 of the contact pieces 11 and the first terminals 3 can be brought into contact with each other through newly-generated surfaces of tin plating, thereby allowing the connection reliability between the first terminals 3 and the short-circuit terminals 13 to be maintained.

In the connector 1 according to the embodiment, it is possible to reduce the manufacturing cost in comparison with a connector having gold-plating films formed on the contact surfaces since the tin-plating films are formed on the contact surfaces of the first terminals 3 and the contact piece 11. Meanwhile, the contact surfaces of the first terminals 3 and the contact pieces 11 are formed with oxide films which increase their contact resistances.

However, since the second housing 9 is provided with the sliding parts 17 which displace the contact pieces 11 to make them slide on the first terminals 3, the oxide films are removed by the slide movements between the contact pieces 11 and the first terminals 3 by the sliding parts 17, thereby allowing the first terminals 3 and the contact pieces 11 to come into contact with each other through the new-generated surfaces.

Accordingly, in the connector 1 according to the embodiment, even if the contact load of the contact pieces 11 is reduced and inexpensive tin-plating films are formed on respective contact surfaces of the first terminals 3 and the contact pieces 11, the oxide films can be removed by the slide movements between the contact pieces 11 and the first terminals 3 by the sliding parts 17, so that it is possible to reduce the manufacturing cost while maintaining the connection reliability between the first terminals 3 and the short-circuit terminals 13.

Additionally, as each of the sliding parts 17 is positioned between the contact pieces 11, 11 of corresponding short-circuit terminal 13, the two contact pieces 11, 11 can be displaced by corresponding sliding part 17 as a single element, so that it is possible to suppress the enlarging of the sliding parts 17.

Although the connector according to the embodiment is configured so as to dispose each of the sliding parts 17 between the contact pieces 11, 11 of corresponding short-circuit terminal 13 and displace the two contact pieces 11, 11 by the single sliding part 17, the connector 1 is not limited to this, and two sliding parts 17, 17 may be provided for the two contact pieces 11, 11 of the respective short-circuit terminals 13, respectively.

Additionally, although each of the releasing parts 15 has only a function of displacing the contact pieces 11, 11 of corresponding short-circuit terminal 13 in the direction away from the corresponding first terminals 3, 3, the present application is not limited to this arrangement. Provided that a plurality of irregularities are formed on each of the releasing parts 15, for instance, it may have a function of sliding on the contact surfaces of the contact pieces 11 and the first terminals 3 when cancelling the fitting between the first housing 5 and the second housing 9, thereby removing the oxide films formed on these contact surfaces.

What is claimed is:

1. A connector, comprising:

a first housing accommodating a plurality of first terminals;

a second housing accommodating a plurality of second terminals connectable to the first terminals and fittable to the first housing;

one or more short-circuit terminals accommodated in the first housing and each having a pair of contact pieces that extend through the first housing to corresponding first terminals and thereby respectively come in contact with the corresponding first terminals;

one or more releasing parts provided in the second housing and each of the one or more releasing parts configured so as to displace corresponding ones of the contact pieces, thereby releasing contacts between the first terminals and the contact pieces;

tin-plating films formed on respective contact surfaces of the first terminals and the contact pieces coming into contact with each other; and one or more sliding parts provided in the second housing and positioned ahead of the releasing parts in a fitting direction between the first housing and the second housing to displace the contact pieces, thereby allowing the contact pieces to slide on the first terminals.

2. The connector of claim 1, wherein:

at least one of the one or more sliding parts is configured to be positioned between the pair of contact pieces of a corresponding short-circuit terminal of the one or more short-circuit terminals.

3. The connector according to claim 1, wherein the contact pieces are adjacent to each other, and the corresponding first terminals are adjacent to each other.

* * * * *